US009595266B2

(12) United States Patent
Beack et al.

(10) Patent No.: US 9,595,266 B2
(45) Date of Patent: Mar. 14, 2017

(54) AUDIO ENCODING/DECODING DEVICE USING REVERBERATION SIGNAL OF OBJECT AUDIO SIGNAL

(71) Applicant: Electronics and Telecommunications Research Institute, Daejeon (KR)

(72) Inventors: Seung Kwon Beack, Daejeon (KR); Jeong Il Seo, Daejeon (KR); Tae Jin Lee, Daejeon (KR); Jong Mo Sung, Daejeon (KR); Kyeong Ok Kang, Daejeon (KR); Jin Woong Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 14/435,372

(22) PCT Filed: Jul. 19, 2013

(86) PCT No.: PCT/KR2013/006471
§ 371 (c)(1),
(2) Date: Apr. 13, 2015

(87) PCT Pub. No.: WO2014/058138
PCT Pub. Date: Apr. 17, 2014

(65) Prior Publication Data

US 2015/0279376 A1 Oct. 1, 2015

(30) Foreign Application Priority Data

Oct. 12, 2012 (KR) ..... 10-2012-0113604
Jun. 17, 2013 (KR) ..... 10-2013-0069101

(51) Int. Cl.

| | |
|---|---|
| ***H04R 5/00*** | (2006.01) |
| ***G10L 19/008*** | (2013.01) |
| ***H04S 7/00*** | (2006.01) |
| *H04S 3/00* | (2006.01) |

(52) U.S. Cl.
CPC ..... *G10L 19/008* (2013.01); *H04S 7/305* (2013.01); *H04S 3/008* (2013.01)

(58) Field of Classification Search
CPC ..... G10L 19/008; H04S 7/305
See application file for complete search history.

(56) References Cited

U.S. PATENT DOCUMENTS

| | | | |
|---|---|---|---|
| 2008/0071549 | A1 | 3/2008 | Chong et al. |
| 2009/0210238 | A1 | 8/2009 | Kim et al. |
| 2010/0145487 | A1 | 6/2010 | Oh et al. |
| 2011/0040396 | A1 | 2/2011 | Kraemer et al. |
| 2011/0166681 | A1 | 7/2011 | Lee et al. |
| 2012/0093321 | A1 | 4/2012 | Shim et al. |

(Continued)

FOREIGN PATENT DOCUMENTS

KR 1020090110242 A 10/2009

*Primary Examiner* — Simon King
(74) *Attorney, Agent, or Firm* — William Park & Associates Ltd.

(57) ABSTRACT

An audio coding and decoding apparatus is disclosed. The audio coding apparatus may include an audio signal encoding unit to encode an audio signal; and a bitstream transmission unit to convert the audio signal into a bitstream and transmit the bitstream, wherein the audio signal comprises a channel audio signal, an object audio signal, and a reverberation signal of the object audio signal.

16 Claims, 8 Drawing Sheets

(56) References Cited

U.S. PATENT DOCUMENTS

| | | | | |
|---|---|---|---|---|
| 2014/0133683 | A1* | 5/2014 | Robinson | H04S 3/008 381/303 |
| 2014/0350944 | A1* | 11/2014 | Jot | G10L 19/008 704/500 |
| 2015/0235645 | A1* | 8/2015 | Hooks | G10L 19/008 704/500 |
| 2015/0271620 | A1* | 9/2015 | Lando | H04S 5/005 381/18 |
| 2015/0350804 | A1* | 12/2015 | Crockett | H04R 5/02 381/307 |

* cited by examiner

AUDIO ENCODING/DECODING DEVICE USING REVERBERATION SIGNAL OF OBJECT AUDIO SIGNAL

TECHNICAL FIELD

The present invention relates to au audio coding and decoding apparatus using a reverberation signal of an object audio signal, and more particularly, to an audio coding and decoding apparatus which encodes and decodes audio using an audio signal including a reverberation signal of an object audio signal.

BACKGROUND ART

According to conventional methods, moving picture expert group (MPEG) spatial audio object coding (SAOC) and Dolby Atmos construct a sound scene using an input signal or an object, respectively.

MPEG SAOC considers an input audio signal as an object and receives the input audio signal. In addition, MPEG SAOC constructs the sound scene only with respect to input rendering information. In particular, MPEG SAOC is capable of transmission at a low bit rate and uses a spatial audio coding method as a high compression method.

Dolby Atmos refers to a multichannel audio format for theatres. Dolby Atmos transmits or stores a channel signal called 'Beds' and an object signal called 'object' and constructs the sound scene using metadata.

However, since the foregoing conventional methods construct the sound scene using the input audio signal or the object signal, in some cases, a sound scene not corresponding to an intention of content according to the input audio signal or the object signal may be included. This is because only base signals for constructing the sound scene are included.

Accordingly, there is a need for a method of constructing a more accurate sound scene corresponding to the intention of content according to the input audio signal or the object signal.

DISCLOSURE OF INVENTION

Technical Goals

An aspect of the present invention provides an audio coding and decoding apparatus capable of reproducing an audio signal more efficiently and realistically, using a channel audio signal, an object audio signal, and a reverberation signal of the object audio signal.

Another aspect of the present invention provides an audio coding and decoding apparatus capable of reconstructing a realistic sound scene according to a reverberation signal of an object audio signal, by rendering the object audio signal and the reverberation signal of the object audio signal.

Technical Solutions

According to an aspect of the present invention, there is provided an audio coding apparatus including an audio signal encoding unit to encode an audio signal, and a bitstream transmission unit to convert the audio signal into a bitstream and transmit the bitstream, wherein the audio signal comprises a channel audio signal, an object audio signal, and a reverberation signal of the object audio signal.

According to an aspect of the present invention, there is provided an audio decoding apparatus including a bitstream receiving unit to receive a bitstream including an encoded audio signal, and an audio signal decoding unit to extract a channel audio signal, an object audio signal, and a reverberation signal of the object audio signal from the bitstream by decoding the audio signal included in the bitstream.

The audio decoding apparatus may further include an audio rendering unit to render the extracted channel audio signal, object audio signal, and reverberation signal of the object audio signal based on the rendering information included in the bitstream.

According to an aspect of the present invention, there is provided an audio coding method including encoding an audio signal, and converting the audio signal into a bitstream and transmitting the bitstream, wherein the audio signal comprises a channel audio signal, an object audio signal, and a reverberation signal of the object audio signal.

According to an aspect of the present invention, there is provided an audio decoding method including receiving a bitstream including an encoded audio signal, extracting a channel audio signal, an object audio signal, and a reverberation signal of the object audio signal from the bitstream by decoding the audio signal included in the bitstream, and rendering the extracted channel audio signal, object audio signal, and reverberation signal of the object audio signal based on rendering information included in the bitstream.

Effects of Invention

According to an embodiment, an audio coding and decoding apparatus may be capable of reproducing an audio signal more efficiently and realistically, by using a channel audio signal, an object audio signal, and a reverberation signal of the object audio signal, in reproducing a multichannel audio signal.

According to an embodiment, an audio coding and decoding apparatus may be to capable of reconstructing a realistic sound scene according to a reverberation signal of an object audio signal, by rendering the object audio signal and the reverberation signal of the object audio signal.

BEST MODE FOR CARRYING OUT THE INVENTION

Figure 1:
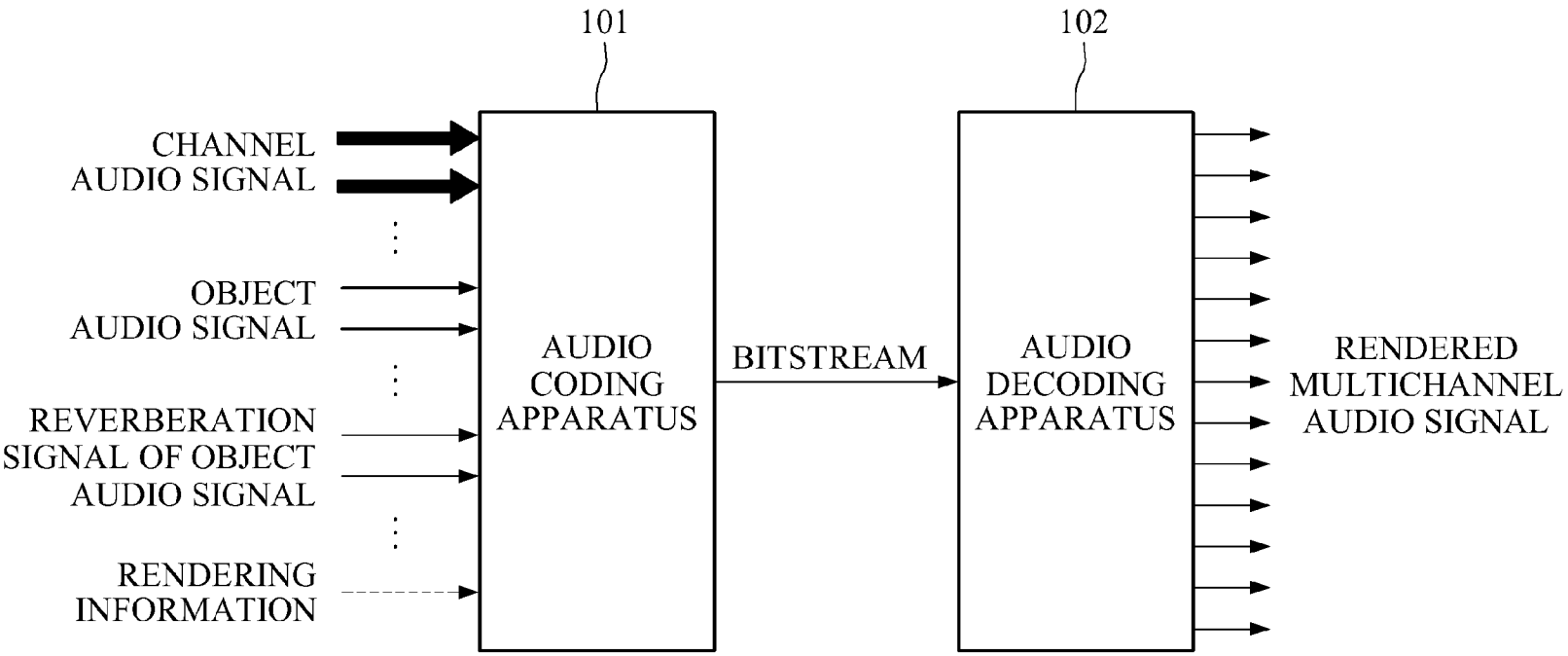
FIG. 1 is a diagram illustrating an audio coding and decoding apparatus according to an embodiment.

Reference will now be made in detail to embodiments of the present invention, examples of which are illustrated in the accompanying drawings, wherein like reference numerals refer to the like elements throughout. The embodiments are described below in order to explain the present invention by referring to the figures.

FIG. 1 is a diagram illustrating an audio coding and decoding apparatus according to an embodiment.

Referring to FIG. 1, an audio coding apparatus 101 may receive an audio signal which includes a channel audio signal, an object audio signal, and a reverberation signal of the object audio signal. Here, the audio coding apparatus 101 may receive the audio signal by considering the channel audio signal, the object audio signal, and the reverberation signal of the object audio signal as an object. The audio coding apparatus 101 is necessary to receive the audio signal including the foregoing three types of audio signal.

In addition, the audio coding apparatus 101 may receive rendering information. The rendering information, as additional data, may include rendering information based on a gain value and rendering information related to a time delay. In case of outputting the audio signal, the rendering information may a sound scene corresponding to the audio signal.

The audio coding apparatus 101 may encode the received audio signal, and convert the rendering information into a bit string. For example, the audio coding apparatus 101 may perform binary conversion to convert the rendering information into the bit string. In addition, the audio coding apparatus 101 may encode the audio signal and the rendering information simultaneously. Here, the audio coding apparatus 101 may include a block for converting the rendering information into the bit string.

The audio coding apparatus 101 may convert the encoded audio signal into the bitstream. The audio coding apparatus 101 may include a block capable of converting the rendering information into the bit string. The audio coding apparatus 101 may convert the rendering information and the encoded audio signal into the bitstream. The bitstream may include the rendering information and the encoded audio signal. In addition, the audio coding apparatus 101 may transmit the bitstream to an audio decoding apparatus 102.

The audio decoding apparatus 102 may receive the bitstream from the audio coding apparatus 101. The audio decoding apparatus 102 may extract the channel audio signal, the object audio signal, and the reverberation signal of the object audio signal from the bitstream by decoding the audio signal included in the received bitstream. Additionally, the audio decoding apparatus 102 may render the extracted audio signal, object audio signal, and reverberation signal of the object audio signal, based on the rendering information included in the bitstream. The audio decoding apparatus 102 may output a rendered multichannel audio signal.

Figure 2:
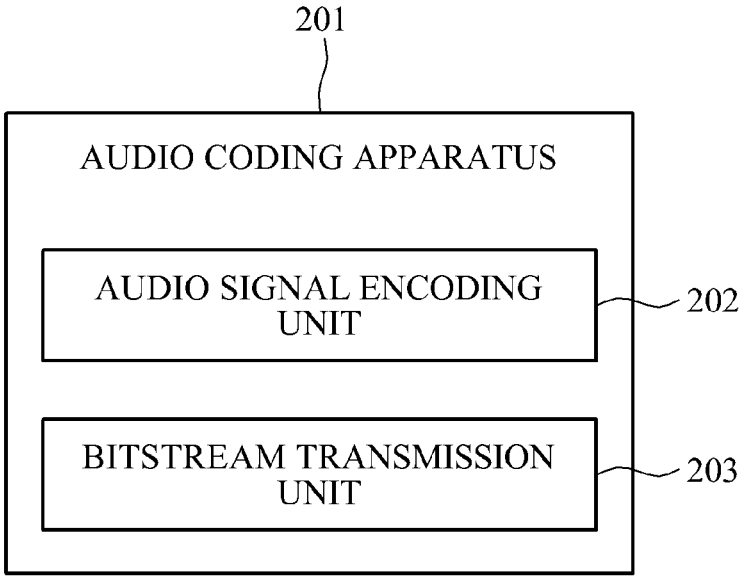
FIG. 2 is a diagram illustrating an audio coding apparatus according to an embodiment.

FIG. 2 is a diagram illustrating an audio coding apparatus 201 according to an embodiment.

Referring to FIG. 2, the audio coding apparatus 201 may include an audio signal encoding unit 202 and a bitstream transmission unit 203.

The audio signal encoding unit 202 may encode the audio signal. The audio signal may include a channel audio signal, an object audio signal, and a reverberation signal of the object audio signal.

The channel audio signal may be a generally used channel audio signal and allocated to a channel of a random reproduction device when reproduced. Here, the channel audio signal may be a signal not varied by the rendering information. The channel audio signal may be expressed by a vector stream with respect to an N-number of channel audio signals using Equation 1.

$$X_{ch}=[x_1^{ch},x_2^{ch}, \ldots ,x_{N-1}^{ch}]^T \text{[Equation 1]}$$

The object audio signal may determine a particular audio signal among a plurality of audio signals as the object audio signal, and use the object audio signal as a subject to perform rendering. Here, the object audio signal may be a signal that may be defined in a predetermined spot through geometry analysis of the reproduction device. The object audio signal may be expressed by a matrix constituted by vector streams with respect to an M-number of object audio signals using Equation 2.

$$X_{obj}=[x_1^{obj},x_2^{obj}, \ldots ,x_{M-1}^{obj}]^T \text{[Equation 2]}$$

Here, Equation 2 may be used when rendering is performed independently from location information and delay information related to the object audio signal.

Here, the object audio signal may be expressed by the matrix because each object audio signal may include a plurality of channel audio signals. For example, when a first object audio signal $x_1^{obj}$ of the object audio signal includes stereo, the object audio signal may be expressed by Equation 3.

$$x_1^{obj}=[x_1^{obj,1},x_r^{obj,1}] \quad \text{[Equation 3]}$$

A reverberation signal of the object audio signal is a reverberation signal applied to the object audio signal, which expresses a sound field feeling of the object audio signal. The reverberation signal of the object audio signal may include reverberation signals of the M-number of object audio signals, corresponding to the object audio signal. The reverberation signal of the object audio signal may be expressed by Equation 4.

$$X_{rev}=[x_1^{rev},x_2^{rev}, \ldots ,x_{M-1}^{rev}]^T \text{[Equation 4]}$$

In addition, in the same manner as the object audio signal, the reverberation signal of the object audio signal may include a plurality of channel audio signals. For example, the reverberation signal of the object audio signal including five 5.1 channels may be expressed by Equation 5.

$$x_1^{rev}=[x_1^{rev,1},x_r^{rev,1},x_c^{rev,1},x_{ls}^{rev,1},x_{rs}^{rev,1}]^T \text{[Equation 5]}$$

Here, the audio signal encoding unit 202 may encode the audio signal by including a reverberation signal having various layouts with respect to the object audio signal.

The bitstream transmission unit 203 may convert the encoded audio signal into a bitstream. The bitstream transmission unit 203 may generate the bitstream from the encoded audio signal and the rendering information for outputting the audio signal. The rendering information may be additional data with respect to the audio signal. That is, the rendering information may be information applied to the audio signal to reproduce scene information related to a sound. The rendering information may include location information of an audio object, sound pressure information of the audio object, and delay information of the audio object. The rendering information may be expressed by Equation 6.

$$R(t)=P(t)G_p(t)+D(t)G_d(t) \quad \text{[Equation 6]}$$

R(t) may refer to the location information of the object audio signal. $G_i(t)$ may refer to the sound pressure of the object audio signal. D(t) may refer to the delay of the object audio signal. $G_1(t)$ and $G_2(t)$ may be scale matrices for controlling the sound pressure with respect to the object audio signal. In addition, t may refer to an index related to time.

When rendering is performed with respect to the location information and the delay information simultaneously, the rendering may be expressed by Equation 7.

$$R(t)=PD(t)G_{pd}(t) \quad \text{[Equation 7]}$$

The bitstream transmission 203 may transmit the bitstream to the audio decoding apparatus.

Figure 3:
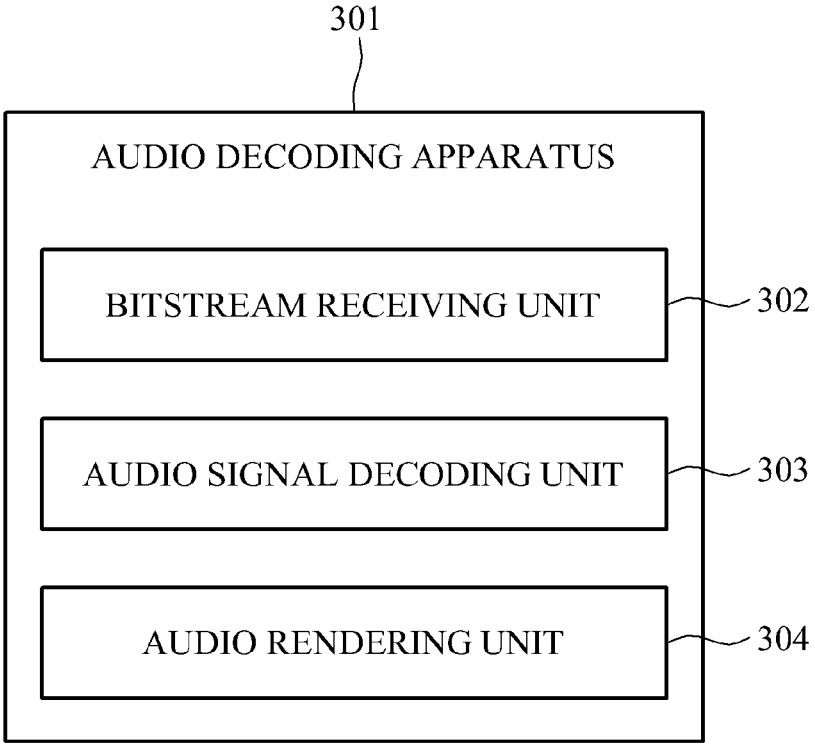
FIG. 3 is a diagram illustrating an audio decoding apparatus according to an embodiment.

FIG. 3 is a diagram illustrating an audio decoding apparatus 301 according to an embodiment.

Referring to FIG. 3, the audio decoding apparatus 301 may include a bitstream receiving unit 302, an audio signal decoding unit 303, an audio rendering unit 304.

The bitstream receiving unit 302 may receive a bitstream including an encoded audio signal from an audio coding apparatus.

The audio signal decoding unit 303 may decode the audio signal included in the bitstream. In detail, the audio signal decoding unit 303 may extract a channel audio signal, an object audio signal, and a reverberation signal of the audio signal from the bitstream. For example, the audio signal decoding unit 303 may be expressed by Equation 8, Equation 9, and Equation 10, corresponding to the extracted channel audio signal, object audio signal, and reverberation signal of the object audio signal.

$$x_{ch}=[X_1^{ch},x_1^{ch}, \ldots ,x_{N-1}^{ch}]^T \quad \text{[Equation 8]}$$

$$x_{obj}=[x_1^{obj},x_2^{obj}, \ldots x_{M-1}^{obj}]^T \quad \text{[Equation 9]}$$

$$x_{rev}=[x_1^{rev},x_2^{rev}, \ldots ,x_{M-1}^{rev}]^T \quad \text{[Equation 10]}$$

The audio rendering unit 304 may render the extracted channel audio signal, object audio signal, and reverberation signal of the object audio signal, based on the rendering information included in the bitstream. The audio rendering unit 304 may construct a sound scene based on scene information related to the sound of the rendering information.

In detail, the audio rendering unit 304 may express a principle of rendering of the audio signal by Equation 11.

$$R(t)\cdot X_{obj} = [P(t)G_p(t) + D(t)G_d(t)]\cdot X_{obj} = \underbrace{P(t)[G_p(t)\cdot X_{obj}]}_{1} + \underbrace{D(t)\cdot[G_d(t)\cdot X_{obj}]}_{2} \quad \text{[Equation 11]}$$

A process of applying a first term of Equation 11 will be described. The sound pressure of the object audio signal may be controlled. The process of controlling the object audio signal may be expressed by Equation 12.

$$G_p(t)\cdot X_{obj} = \begin{bmatrix} g_{p,0} & \cdots & 0 \\ \vdots & \ddots & \vdots \\ 0 & \cdots & g_{p,M-1} \end{bmatrix} \begin{bmatrix} x_0^{obj} \\ \vdots \\ x_{M-1}^{obj} \end{bmatrix} = \begin{bmatrix} g_{p,0}\cdot x_0^{obj} \\ \vdots \\ g_{p,M-1}\cdot x_{M-1}^{obj} \end{bmatrix} = X'_{obj} \quad \text{[Equation 12]}$$

$x'_{obj}$ with the sound pressure controlled may be allocated to a speaker position of a reproduction device, where output is actually performed by a sound image localization matrix P(t). Elements of the sound image localization matrix P(t) may be expressed by gain values of the sound pressure. Here, the gain value may include a real number between 0 and 1. In addition, when a number of channels capable of outputting is N, $x'_{obj}$ may be applied to the image localization matrix as in Equation 13.

$$P(t)G_p(t)\cdot X_{obj} = \begin{bmatrix} p_{0,0} & p_{0,1} & \cdots & p_{0,M-1} \\ p_{1,0} & \ddots & & \\ \vdots & & p_{i,j} & \vdots \\ & & \ddots & \\ p_{N-1,0} & & \cdots & p_{N-1,M-1} \end{bmatrix} \begin{bmatrix} g_{p,0}\cdot x_0^{obj} \\ \vdots \\ g_{p,j}x_j^{obj} \\ \vdots \\ g_{p,M-1}\cdot x_{M-1}^{obj} \end{bmatrix} \quad \text{[Equation 13]}$$

In Equation 13, when the object audio signal $x_j^{obj}$ includes a J-number of layouts, the object audio signal $x_j^{obj}$ may be expressed by Equation 14.

$$x_j^{obj}=[x_0^{obj}, \ldots ,x_{J-1}^{obj}]^T \quad \text{[Equation 14]}$$

As to the sound image localization matrix, calculation process of each element of the sound image localization matrix may be described through Equation 15.

$$p_{i,j}\cdot x_j^{obj} = [\, p_0^{i,j} \;\; \ldots \;\; p_{L-1}^{i,j} \,] \begin{bmatrix} x_0^{obj,j} \\ \vdots \\ x_{L-1}^{obj,j} \end{bmatrix} = \sum_{l=0}^{L-1} p_l^{i,j}\cdot x_l^{obj,j} \quad \text{[Equation 15]}$$

Therefore, a signal output by the sound image localization matrix P(t) may be expressed by Equation 16.

$$P(t)G_1(t)\cdot X_{obj} = \begin{bmatrix} p_{0,0} & p_{0,1} & \cdots & p_{0,M-1} \\ p_{1,0} & \ddots & & \\ \vdots & & p_{i,j} & \vdots \\ & & \ddots & \\ p_{N-1,0} & & \cdots & p_{N-1,M-1} \end{bmatrix} \begin{bmatrix} g_{p,0}\cdot x_0^{obj} \\ \vdots \\ g_{p,j}x_j^{obj} \\ \vdots \\ g_{p,M-1}\cdot x_{M-1}^{obj} \end{bmatrix} = \quad \text{[Equation 16]}$$

$$\begin{bmatrix} g_{p,0}\left(\sum_{l=0}^{L-1} p_l^{0,0}\cdot x_l^{obj,0} + \ldots + \sum_{l=0}^{L-1} p_l^{0,M-1}\cdot x_l^{obj,M-1}\right) \\ \vdots \\ g_{p,j}\left(\sum_{l=0}^{L-1} p_l^{i,0}\cdot x_l^{obj,0} + \ldots + \sum_{l=0}^{L-1} p_l^{i,M-1}\cdot x_l^{obj,M-1}\right) \\ \vdots \\ g_{p,M-1}\left(\sum_{l=0}^{L-1} p_l^{N-1,0}\cdot x_l^{obj,0} + \ldots + \sum_{l=0}^{L-1} p_l^{N-1,M-1}\cdot x_l^{obj,M-1}\right) \end{bmatrix}$$

A second term of Equation 10 may perform matrix calculation of a same dimension. The matrix calculation of the dimension may be expressed by Equation 17.

$$D(t)G_d(t)\cdot X_{obj} = \begin{bmatrix} d_{0,0} & d_{0,1} & \cdots & d_{0,M-1} \\ d_{1,0} & \ddots & & \\ \vdots & & d_{i,j} & \vdots \\ & & & \ddots \\ d_{N-1,0} & & \cdots & d_{N-1,M-1} \end{bmatrix} \begin{bmatrix} g_{d,0}\cdot x_0^{obj} \\ \vdots \\ g_{d,j}x_j^{obj} \\ \vdots \\ g_{d,M-1}\cdot x_{M-1}^{obj} \end{bmatrix} \quad \text{[Equation 17]}$$

In addition, the object audio signal $x_j^{obj}$ of Equation 17 including the J-number of layouts may be expressed by Equation 18.

$$d_{i,j}\cdot x_j^{obj} = [\, d_0^{i,j} \;\; \ldots \;\; d_{L-1}^{i,j} \,] \begin{bmatrix} x_0^{obj,j} \\ \vdots \\ x_{L-1}^{obj,j} \end{bmatrix} = \sum_{l=0}^{L-1} p_l^{i,j}\cdot x_l^{obj,j} = \sum_{l=0}^{L-1} x_l^{obj,j}(t-p_l^{i,j}) \quad \text{[Equation 18]}$$

Here, since the delay calculation process of the object audio signal cannot be expressed through matrix multiplication, different from the sound image localization matrix application calculation, the delay calculation process may be expressed using an operator ○. In addition, a signal output through the delay calculation matrix D(t) may be expressed by Equation 19.

$$D(t)G_1(t)\cdot X_{obj} = \begin{bmatrix} d_{0,0} & d_{0,1} & \cdots & d_{0,M-1} \\ d_{1,0} & \ddots & & \\ \vdots & & d_{i,j} & \vdots \\ & & & \ddots \\ d_{N-1,0} & & \cdots & d_{N-1,M-1} \end{bmatrix} \cdot \quad \text{[Equation 19]}$$

$$\begin{bmatrix} g_{d,0}\cdot x_0^{obj} \\ \vdots \\ g_{d,j}x_j^{obj} \\ \vdots \\ g_{d,M-1}\cdot x_{M-1}^{obj} \end{bmatrix} = \begin{bmatrix} g_{d,0}\left(\sum_{l=0}^{L-1} x_l^{obj,0}(t-d_l^{0,0}) + \ldots + \sum_{l=0}^{L-1} x_l^{obj,,M-1}(t-d_l^{0,M-1})\right) \\ \vdots \\ g_{d,j}\left(\sum_{l=0}^{L-1} x_l^{obj,0}(t-d_l^{i,0}) + \ldots + \sum_{l=0}^{L-1} x_l^{obj,M-1}(t-d_l^{i,M-1})\right) \\ \vdots \\ g_{d,M-1}\left(\sum_{l=0}^{L-1} x_l^{obj,0}(t-d_l^{N-1,0}) + \ldots + \sum_{l=0}^{L-1} x_l^{obj,M-1}(t-d_l^{N-1,M-1})\right) \end{bmatrix}$$

The audio rendering unit 304 may apply the sound image localization matrix and the delay calculation matrix independently. When the audio rendering unit 304 applies the sound image localization matrix and the delay calculation matrix simultaneously, a matrix PD(t) may be expressed using Equation 20.

$$R(t)\cdot X_{obj} = PD(t)G_{pd}(t)\cdot X_{obj} = \begin{bmatrix} p_{0,0}d_{0,0} & p_{0,1}d_{0,1} & \cdots & p_{0,M-1}d_{0,M-1} \\ p_{1,0}d_{1,0} & \ddots & & \\ \vdots & & p_{i,j}d_{i,j} & \vdots \\ & & & \ddots \\ p_{N-1,0}d_{N-1,0} & & \cdots & p_{N-1,M-1}d_{N-1,M-1} \end{bmatrix} \begin{bmatrix} g_{pd,0}\cdot x_0^{obj} \\ \vdots \\ g_{pd,j}x_j^{obj} \\ \vdots \\ g_{pd,M-1}\cdot x_{M-1}^{obj} \end{bmatrix} \quad \text{[Equation 20]}$$

Through the calculation of Equation 20, the audio rendering unit 304 may extract a result as shown in Equation 21.

$$PD(t)G_{pd}(t)\cdot X_{obj} = \begin{bmatrix} g_{pd,0}\cdot\left(\sum_{l=0}^{L-1} p_l^{0,0}x_l^{obj,0}(t-d_l^{0,0}) + \ldots + \sum_{l=0}^{L-1} p_l^{0,M-1}x_l^{obj,M-1}(t-d_l^{0,M-1})\right) \\ \vdots \\ g_{pd,j}\cdot\left(\sum_{l=0}^{L-1} p_l^{i,0}x_l^{obj,0}(t-d_l^{i,0}) + \ldots + \sum_{l=0}^{L-1} p_l^{i,M-1}x_l^{obj,M-1}(t-d_l^{i,M-1})\right) \\ \vdots \\ g_{pd,M-1}\cdot\left(\sum_{l=0}^{L-1} p_l^{N-1,0}x_l^{obj,0}(t-d_l^{N-1,0}) + \ldots + \sum_{l=0}^{L-1} p_l^{N-1,M-1}x_l^{obj,M-1}(t-d_l^{N-1,M-1})\right) \end{bmatrix} \quad \text{[Equation 21]}$$

The audio rendering unit 304 may allocate the object audio signal to a channel signal which may be output, using the foregoing equation. In addition, the audio rendering unit 304 may combine the allocated object audio signal with the decoded channel audio signal. Additionally, the audio rendering unit 304 may generate an output signal to be finally output.

The audio rendering unit 304 may render the reverberation signal of the object audio signal as shown in Equation 22 or Equation 23.

$$R(t)\cdot X_{rev} = [P(t)G_p(t) + D(t)G_d(t)]X_{rev} = P(t)[G_pX\cdot X_{rev}] + D(t)\circ[G_d(t)\cdot X_{rev}] \quad \text{[Equation 22]}$$

$$R(t)\cdot X_{obj} = PD(t)G_{pd}(t)\cdot X_{rev} \quad \text{[Equation 23]}$$

Rendering of the reverberation signal of the object audio signal using Equation 22 and Equation 23 may render the object audio signal. By rendering the reverberation signal of the object audio signal corresponding to the object audio signal, the sound scene with higher reality may be implemented.

In addition, when controlling the object audio signal, the audio rendering unit 304 may control the reverberation signal of the object audio signal corresponding to the object audio signal. For example, when intending to control during rendering of the object audio signal $x_j^{obj}$, the audio rendering unit 304 may allocate a solution of the gain value of Equation 11 as in $g_{pj}=g_{dj}=0$. In addition, the audio rendering unit 304 may control the reverberation signal corresponding an index of the object audio signal in the same manner as $g_{pdj}=0$ of Equation 11. Furthermore, the audio rendering unit 304 may allocate the solution of the gain value of Equation 22 as in $g_{pj}=g_{dj}=0$, or control the object audio signal as in $g_{pdj}=0$ of Equation 23.

The output signal to be finally output may be an integrated signal of the rendered object audio signal, the reverberation signal of the rendered object audio signal, and the decoded channel audio signal. The output signal may be expressed by Equation 24.

$$y_{ch}=x'_{ch}+R_{obj}(t)\cdot X_{obj}-R_{rev}(t)\cdot X_{rev} \quad \text{[Equation 24]}$$

In Equation 24, the output signal may be separated into $R_{obj}(t)$ and $R_{rev}(t)$. That is, the output signal may be transmitted through different methods as information on the rendered object audio signal and information on the reverberation signal of the object audio signal. Therefore, Equation 23 shows that the output signal is to be transmitted as $R_{obj}(t)$ and $R_{rev}(t)$ as the rendering information.

In Equation 23, the decoded channel audio signal is denoted by $x'_{ch}$ since the decoded channel audio signal $x'_{ch}$ is expressed in the form of a downmixed signal when the number of channels for final output does not correspond to the decoded channel audio signals. For example, when the number of the decoded channel audio signals is N and the number of output signals output through the $R_{obj}(t)$ and $R_{rev}(t)$ and the channels is K, $x_{ch}$ may be converted into $x'_{ch}$ through a downmix matrix. That is, a number of dimensions of a row matrix of the $R_{obj}(t)$ and $R_{rev}(t)$ may also be K.

Here, the downmix matrix may be expressed by Equation 25.

$$x'_{ch}=DMX(t)\cdot x_{ch} \quad \text{[Equation 25]}$$

Based on Equation 25, when the number of the decoded channel audio signals is N and the number of the output signals is K, the downmixing process may be expressed by Equation 26.

$$x'_{ch}=DMX(t)\cdot x_{ch}=\begin{bmatrix} c_{0,0} & \cdots & c_{0,N-1} \\ \vdots & & \vdots \\ c_{K-1,0} & \cdots & c_{K-1,N-1} \end{bmatrix}\begin{bmatrix} x_0 \\ x_1 \\ \vdots \\ x_{N-1} \end{bmatrix} \quad \text{[Equation 26]}$$

Here, when the number of dimensions of the row matrix of the $R_{obj}(t)$ and $R_{rev}(t)$ is also N, the output signal may be expressed by Equation 27, by reflecting Equation 24 to Equation 23.

$$y_{ch}=DMX(t)[x_{ch}+R_{obj}(t)\cdot X_{obj}+R_{rev}(t)\cdot X_{rev}] \quad \text{[Equation 27]}$$

That is, after rendering with respect to the N-number of channel audio signals is performed, the output signal may be downmixed by using DMX(t). In addition, the time index t may be varied according to time of information of DMX(t).

The audio coding apparatus 101 and the audio decoding apparatus 102 may fully reflect a content production intention of an original sound engineer, using the reverberation signal of the object audio signal corresponding to the object audio signal. The audio coding apparatus 101 and the audio decoding apparatus 102 may control the reverberation signal of the object audio signal. Therefore, the audio coding apparatus 101 and the audio decoding apparatus 102 may include rendering information corresponding to the reverberation signal of the object audio signal, for additional control of the reverberation signal.

Figure 4:
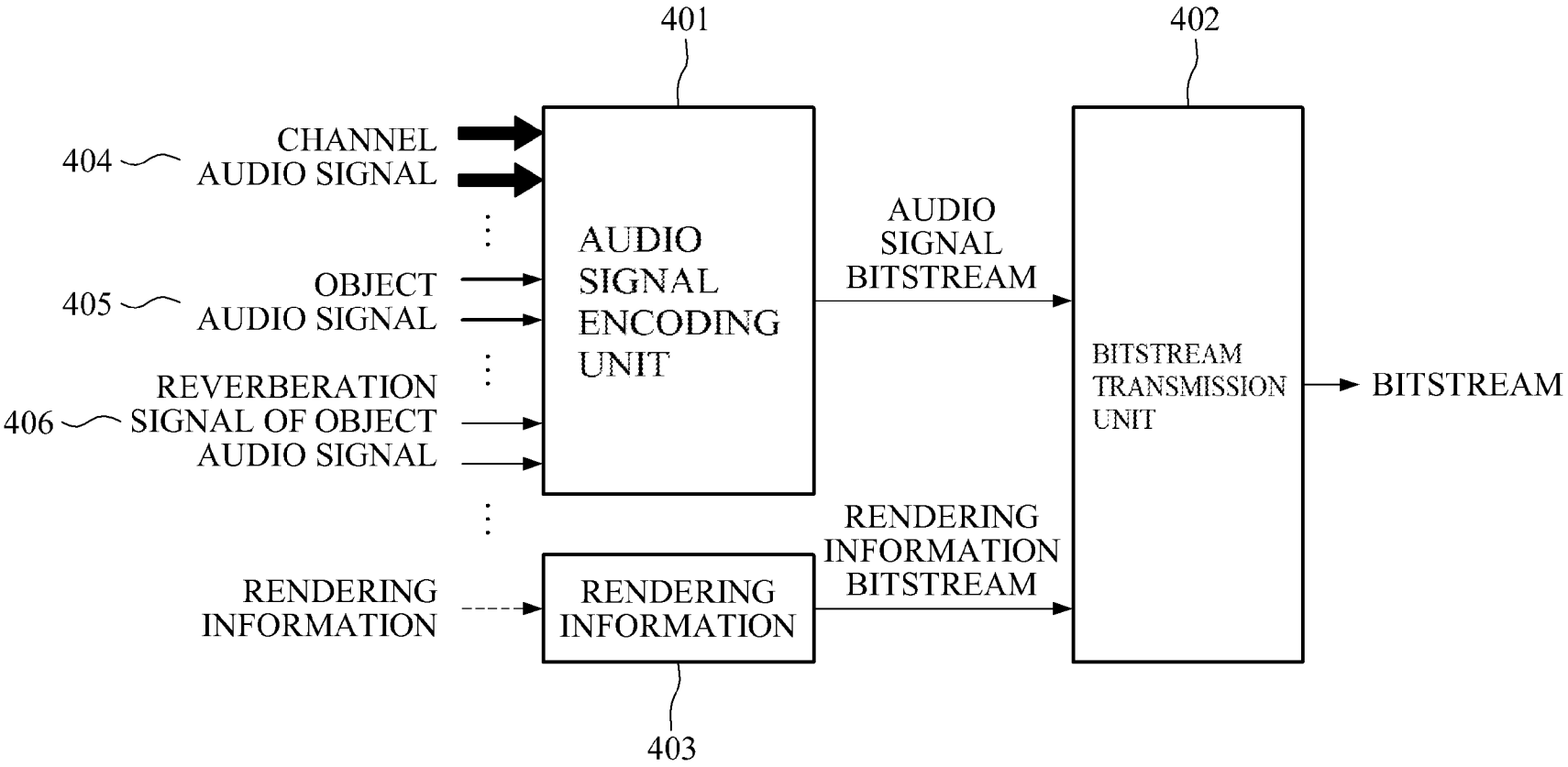
FIG. 4 is a diagram illustrating the audio coding apparatus of FIG. 2 in detail.

FIG. 4 is a diagram illustrating the audio coding apparatus of FIG. 2 in detail.

Referring to FIG. 4, the audio coding apparatus may include an audio signal encoding unit 401 and a bitstream transmission unit 402.

The audio signal encoding unit 401 may receive a channel audio signal, an object audio signal, and a reverberation signal of the object audio signal. Here, the audio signal encoding unit 401 may implement a sound scene of a higher quality by receiving the reverberation signal of the object audio signal. Additionally, the audio signal encoding unit 401 may encode the received channel audio signal, object audio signal, reverberation signal of the object audio signal into an audio signal.

In addition, the audio coding apparatus may receive rendering information 403. The audio coding apparatus may include a block for converting the rendering information 403 into a binary form.

Here, when the audio signal encoding unit 401 includes the block for converting the rendering information 403, the audio signal encoding unit 401 may encode to the audio signal including the channel audio signal, the object audio signal, the reverberation signal of the object audio signal, and the rendering information 403.

The bitstream transmission unit 402 may convert the audio signal into a bitstream, and transmit the bitstream to the audio decoding apparatus. The bitstream may include the audio signal including the channel audio signal, the object audio signal, and the reverberation signal of the object audio signal, and the rendering information 403. The bitstream transmission unit 402 may transmit the bitstream to generate multichannel scene information. The multichannel scene information may be generated based on the rendering information 403. The rendering information 403 may be used as additional data with respect to the reverberation signal of the object audio signal.

Figure 5:
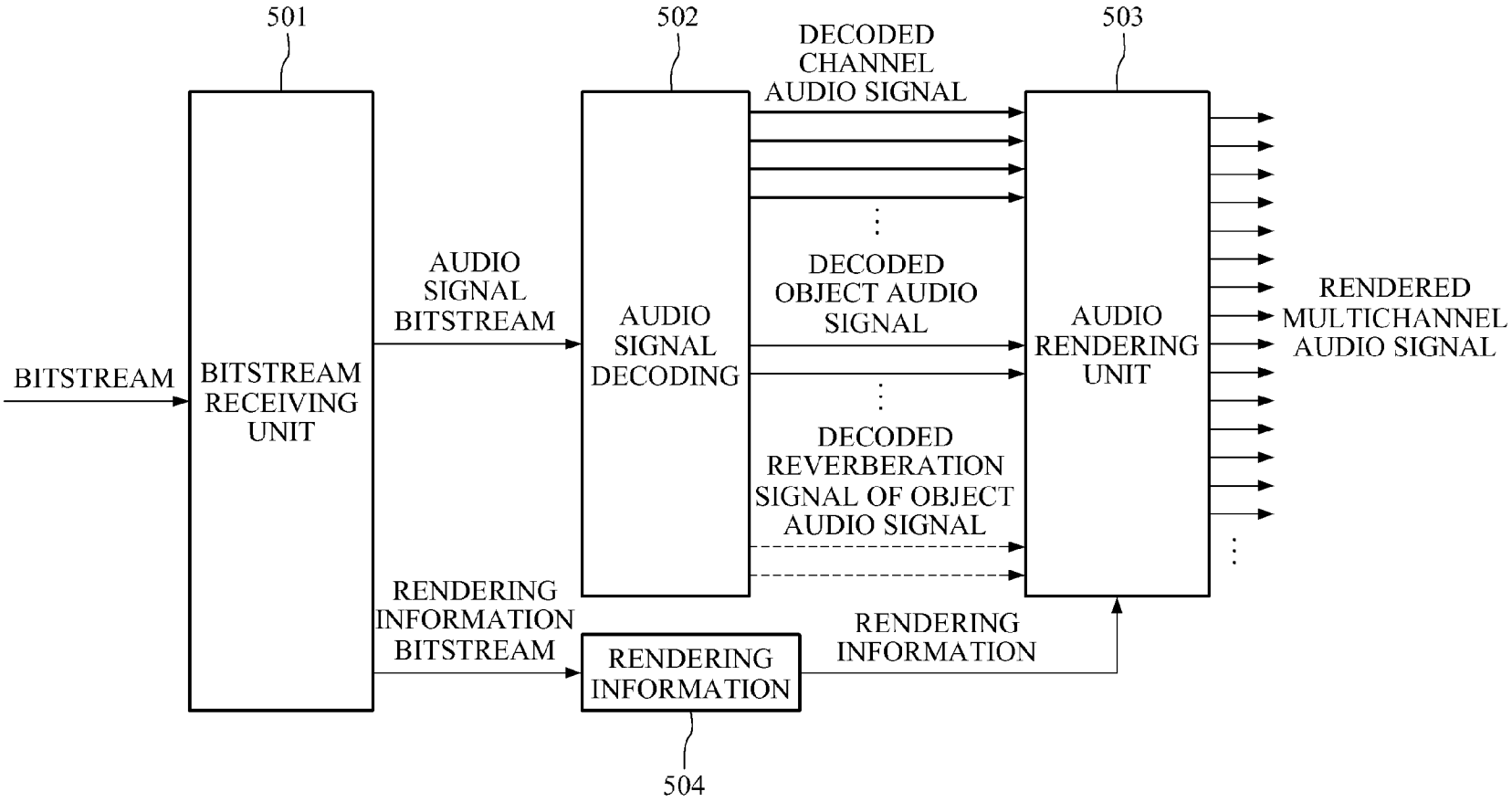
FIG. 5 is a diagram illustrating the audio decoding apparatus of FIG. 3 in detail.

FIG. 5 is a diagram illustrating the audio decoding apparatus of FIG. 3 in detail.

The audio decoding apparatus may include a bitstream receiving unit 501, an audio signal decoding unit 502, and an audio rendering unit 503.

The bitstream receiving unit 501 may receive a bitstream from an audio coding apparatus. The received bitstream may include the audio signal and the rendering information.

The audio signal decoding unit 502 may decode the audio signal. That is, the audio signal decoding unit 502 may extract the channel audio signal, the object audio signal, and the reverberation signal of the object audio signal included in the audio signal.

The audio rendering unit 503 may perform rendering with respect to the decoded channel audio signal, object audio signal, and reverberation signal of the object audio signal. The object audio signal may be rendered based on the rendering process of FIG. 3. When the object audio signal is rendered, the reverberation signal of the object audio signal may be rendered according to an index of the corresponding object audio signal. The reverberation signal of the object audio signal may be controlled in the same manner as the object reverberation signal being controlled, thereby providing a more realistic sound image.

The audio rendering unit 503 may generate the output signal by rendering the decoded channel audio signal, object audio signal, reverberation signal of the object audio signal. Here, the output signal may include the rendered object audio signal, the reverberation signal of the rendered object audio signal, and the decoded channel audio signal. The output signal may be output to channels of the multichannel audio signal.

Figure 6:
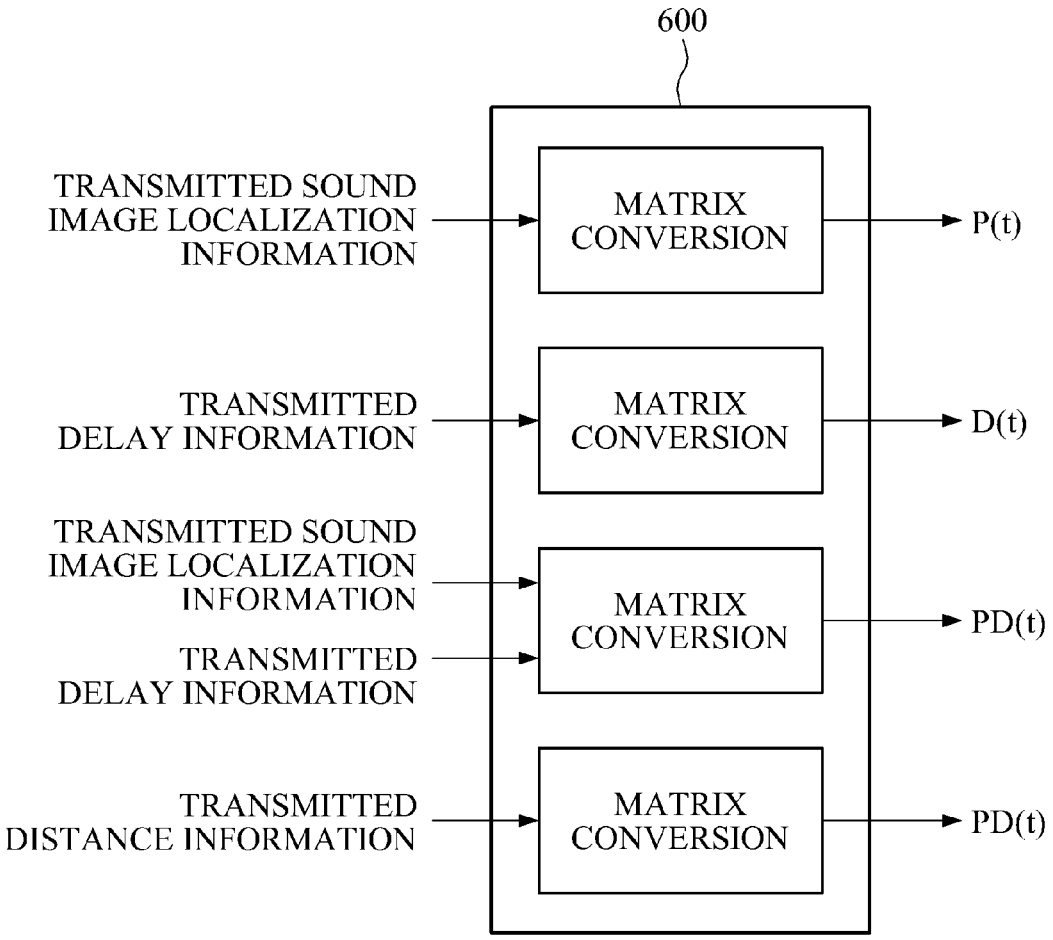
FIG. 6 is a diagram illustrating a configuration of rendering information.

FIG. 6 is a diagram illustrating a configuration of rendering information 600.

Referring to FIG. 6, the rendering information 600 may be expressed in a matrix form. Each matrix of the rendering information 600 may be expressed by a substitute value to express the rendering information. For example, location information of the object may be expressed by angles of a horizontal plane and a vertical plane. A matrix value and a gain value related to delay information may be substituted by a value indicating a distance. In addition, the rendering information 600 needs to be expressed by being converted into a matrix value to be applied to the rendered object audio signal and the reverberation signal of the rendered object audio signal corresponding to the rendering information 600 input in various types to be used as additional data of the reverberation signal of the object audio signal.

Figure 7:
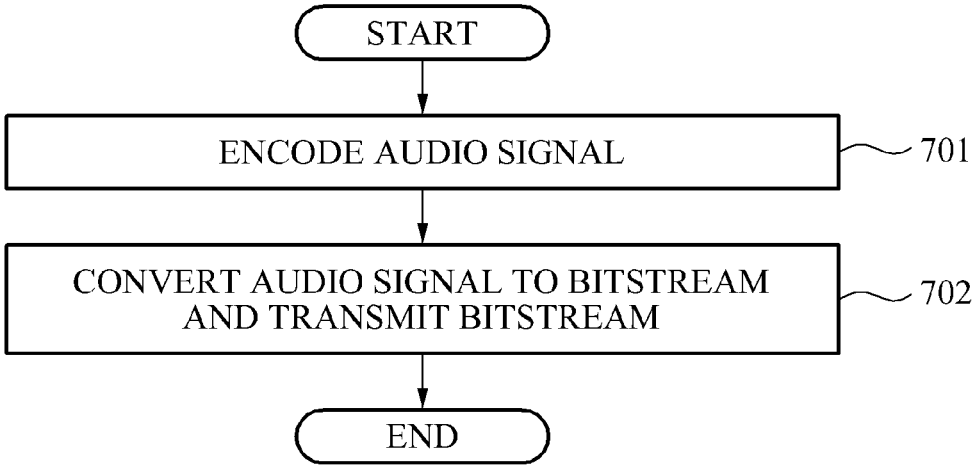
FIG. 7 is a diagram illustrating an audio coding method according to an embodiment.

FIG. 7 is a diagram illustrating an audio coding method according to an embodiment.

In operation 701, an audio coding apparatus may include a channel audio signal, an object audio signal, and a reverberation signal of the object audio signal. The channel audio signal may be a generally used channel audio signal allocated to a channel of a predetermined reproduction device during reproduction. The object audio signal may define a particular audio signal among a plurality of audio signals and use the particular audio signal as a subject performing rendering. The reverberation signal of the object audio signal may be applied to the object audio signal and express a sound field feeling of the object audio signal.

The audio coding apparatus may encode the received channel audio signal, the object audio signal, and the reverberation signal of the object audio signal into an audio signal.

In operation 702, the audio coding apparatus may convert the audio signal into a bitstream. The bitstream may include the audio signal including the channel audio signal, the object audio signal, and the reverberation signal of the object audio signal, and rendering information 403. The audio coding apparatus may transmit the bitstream to generate multichannel scene information.

Figure 8:
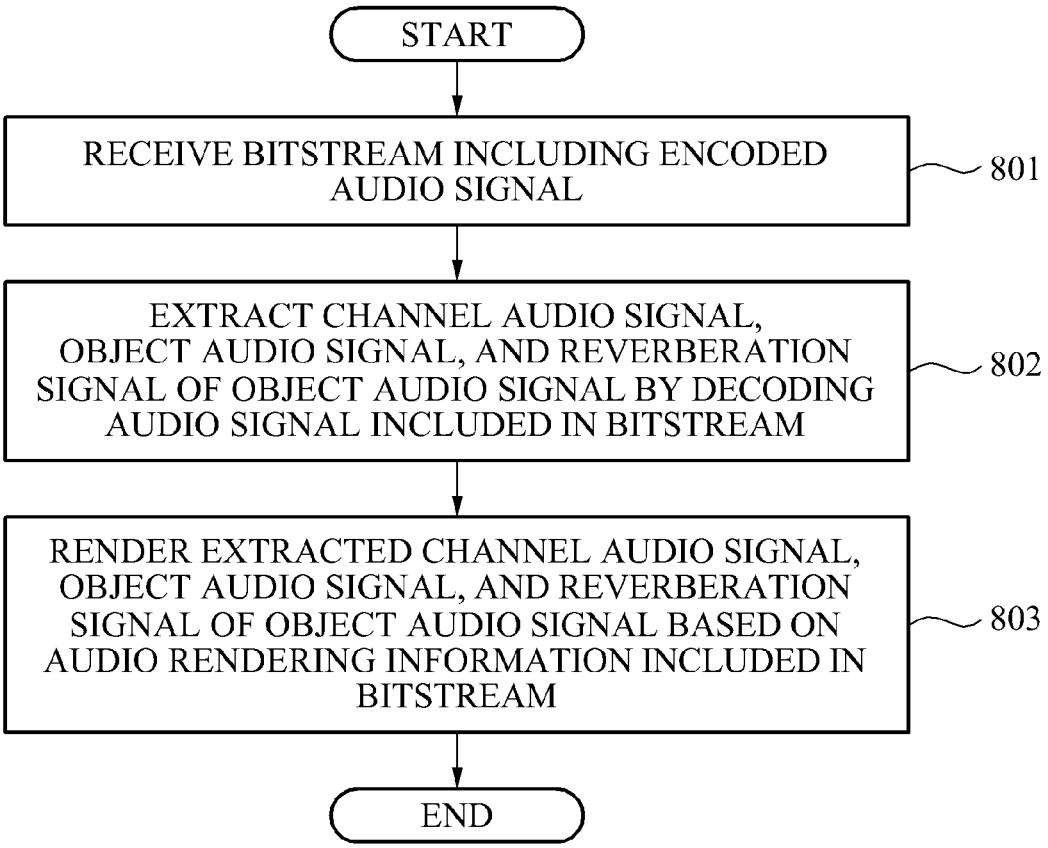
FIG. 8 is a diagram illustrating an audio decoding method according to an embodiment.

FIG. 8 is a diagram illustrating an audio decoding method according to an embodiment.

In operation 801, an audio decoding apparatus may receive a bitstream from an audio coding apparatus. The received bitstream may include an audio signal and rendering information.

In operation 802, the audio decoding apparatus may decode the audio signal, thereby extracting a channel audio signal, an object audio signal, and a reverberation signal of the object audio signal included in the audio signal.

In operation 803, the audio decoding apparatus may render the extracted channel audio signal, object audio signal, and reverberation signal of the object audio signal based on the rendering information included in the bitstream. When the object audio signal is rendered, the reverberation signal of the object audio signal may be rendered according to an index of the corresponding object audio signal. In addition, the reverberation signal of the object audio signal may be controlled in the same manner as the object audio signal being controlled, thereby providing a more realistic sound image. Furthermore, the audio decoding apparatus may generate an output signal by rendering the decoded channel audio signal, object audio signal, and reverberation signal of the object audio signal.

The above-described embodiments of the present invention may be recorded in non-transitory computer-readable media including program instructions to implement various operations embodied by a computer. The media may also include, alone or in combination with the program instructions, data files, data structures, and the like. The program instructions recorded on the media may be those specially designed and constructed for the purposes of the embodiments, or they may be of the kind well-known and available to those having skill in the computer software arts.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents.

Accordingly, other implementations are within the scope of the following claims.

The invention claimed is:

1. An audio coding apparatus comprising:

an audio signal encoding unit to encode an audio signal and a rendering information; and a bitstream transmission unit to convert the audio signal and the rendering information into a bitstream and transmit the bitstream, wherein the audio signal comprises a channel audio signal, an object audio signal, and a reverberation signal of the object audio signal, wherein the rendering information indicates sound scene information with respect to the object audio signal.

2. The audio coding apparatus of claim 1, wherein the reverberation signal of the object audio signal expresses a sound field feeling of the object audio signal.

3. The audio coding apparatus of claim 1, wherein the reverberation signal of the object audio signal comprises a plurality of channel signals.

4. The audio coding apparatus of claim 1, wherein the reverberation signal of the object audio signal provides various layouts with respect to the object audio signal.

5. The audio coding apparatus of claim 1, wherein the bitstream transmission unit generates the bitstream from the encoded audio signal and the rendering information for generation of the audio signal.

6. The audio coding apparatus of claim 1, wherein the rendering information comprises at least one of location information of an audio object, sound pressure information of the audio object, and delay information of the audio object.

7. An audio decoding apparatus comprising:

a bitstream receiving unit to receive a bitstream including an encoded audio signal and a rendering information; and an audio signal decoding unit to extract a channel audio signal, an object audio signal, and a reverberation signal of the object audio signal from the bitstream by decoding the audio signal included in the bitstream, wherein the rendering information indicates sound scene information with respect to the object audio signal.

8. The audio decoding apparatus of claim 7, wherein the reverberation signal of the object audio signal expresses a sound field feeling of the object audio signal.

9. The audio decoding apparatus of claim 7, wherein the reverberation signal of the object audio signal comprises a plurality of channel signals.

10. The audio decoding apparatus of claim 8, wherein the reverberation signal of the object audio signal provides various layouts with respect to the object audio signal.

11. The audio decoding apparatus of claim 7, further comprising:

an audio rendering unit to render the extracted channel audio signal, object audio signal, and reverberation signal of the object audio signal based on the rendering information included in the bitstream.

12. The audio decoding apparatus of claim 11, wherein the rendering information comprises at least one of location information of an audio object, sound pressure information of the audio object, and delay information of the audio object.

13. The audio decoding apparatus of claim 11, wherein the audio rendering unit controls the reverberation signal of the object audio signal corresponding to the object audio signal, when controlling the object audio signal.

14. The audio decoding apparatus of claim 11, wherein the audio rendering unit controls the reverberation signal of the object audio signal in consideration of an index of the object audio signal corresponding to the reverberation signal of the object audio signal.

15. An audio decoding method comprising:

receiving a bitstream comprising an encoded audio signal and a rendering information;

extracting a channel audio signal, an object audio signal, and a reverberation signal of the object audio signal from the bitstream by decoding the audio signal included in the bitstream; and rendering the extracted channel audio signal, object audio signal, and reverberation signal of the object audio signal based on the rendering information included in the bitstream, wherein the rendering information comprises sound scene information with respect to the object audio signal.

16. The audio decoding method of claim 15, wherein the reverberation signal of the object audio signal comprises a plurality of channel signals, expresses a sound field feeling of the object audio signal, and provides various layouts with respect to the object audio signal.

* * * * *